US010339951B2

(12) United States Patent
Scheler

(10) Patent No.: US 10,339,951 B2
(45) Date of Patent: Jul. 2, 2019

(54) AUDIO SIGNAL PROCESSING IN A VEHICLE

(71) Applicant: Volkswagen Aktiengesellschaft, Wolfsburg (DE)

(72) Inventor: David Scheler, Berlin (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 15/775,097

(22) PCT Filed: Oct. 26, 2016

(86) PCT No.: PCT/EP2016/075831
§ 371 (c)(1),
(2) Date: May 10, 2018

(87) PCT Pub. No.: WO2017/080830
PCT Pub. Date: May 18, 2017

(65) Prior Publication Data

US 2018/0358031 A1 Dec. 13, 2018

(30) Foreign Application Priority Data

Nov. 10, 2015 (DE) ..... 10 2015 222 105

(51) Int. Cl.
*H04R 3/02* (2006.01)
*G10L 21/0232* (2013.01)
(Continued)

(52) U.S. Cl.
CPC ..... *G10L 21/0232* (2013.01); *G10L 21/0208* (2013.01); *H04R 3/02* (2013.01);
(Continued)

(58) Field of Classification Search
CPC ..... G10L 21/0232; G10L 2021/02082; G10L 2021/02166; H04R 3/02; H04R 5/02;
(Continued)

(56) References Cited

U.S. PATENT DOCUMENTS 5,828,756 A 10/1998 Benesty et al. ..... 381/66
6,665,645 B1 12/2003 Ibaraki et al. ..... 704/275
(Continued)

FOREIGN PATENT DOCUMENTS

DE 102015222105 A1 5/1917 ..... H04S 1/00
DE 102008027848 A1 1/2009 ..... H04M 1/58
(Continued)

OTHER PUBLICATIONS

Benesty et al., A Hybrid Mono/Stereo Acoustic Echo Canceller, IEEE Transactions on Speech and Audio Processing, vol. 6 No. 5, pp. 468-475.*
(Continued)

*Primary Examiner* — Ahmad F. Matar
*Assistant Examiner* — Sabrina Diaz
(74) *Attorney, Agent, or Firm* — Slayden Grubert Beard PLLC

(57) ABSTRACT

The present invention relates to a method for audio signal processing in a vehicle. In order to allow simple and reliable echo cancellation for voice recognition during simultaneous reproduction of a multichannel audio source signal in a vehicle, a mono audio signal is generated on the basis of a multichannel audio source signal. The mono audio signal is limited to a frequency range between a prescribed lower frequency and a prescribed upper frequency, for example to a range from 100 Hz to 8 kHz. The limited mono audio signal is output via multiple loudspeakers in the vehicle. An influence of the limited mono audio signal that is output via the multiple loudspeakers on a voice audio signal received
(Continued)

in the vehicle via a microphone is compensated for by means of the limited mono audio signal in an echo canceller.

14 Claims, 2 Drawing Sheets

(51) Int. Cl.

| | |
|---|---|
| ***H04S 7/00*** | (2006.01) |
| ***G10L 21/0208*** | (2013.01) |
| ***H04R 5/02*** | (2006.01) |
| *G10L 21/0216* | (2013.01) |
| *H04R 5/04* | (2006.01) |

(52) U.S. Cl.
CPC ..... *H04R 5/02* (2013.01); *H04S 7/307* (2013.01); *G10L 2021/02082* (2013.01); *G10L 2021/02161* (2013.01); *G10L 2021/02166* (2013.01); *H04R 5/04* (2013.01); *H04R 2430/03* (2013.01); *H04R 2499/13* (2013.01); *H04S 2400/05* (2013.01)

(58) Field of Classification Search
CPC ..... H04R 5/04; H04R 5/023; H04R 2499/13; H04S 7/307; H04S 2400/05; H04S 3/00; G10K 2210/1282; G10K 11/1788; G10K 11/1786; G10K 11/178; G10K 11/1784
USPC ..... 381/300, 302, 17, 389, 11, 71.4, 86
See application file for complete search history.

(56) References Cited

U.S. PATENT DOCUMENTS

| | | | | |
|---|---|---|---|---|
| 8,594,320 | B2 * | 11/2013 | Faller | H04M 9/082 379/390.01 |
| 8,644,496 | B2 | 2/2014 | Matsuo | 379/406.12 |
| 9,020,823 | B2 | 4/2015 | Hoepken et al. | 704/275 |
| 2005/0213747 | A1 | 9/2005 | Pop et al. | 379/406.03 |
| 2006/0182268 | A1 | 8/2006 | Marton | 379/406.08 |
| 2012/0232890 | A1 * | 9/2012 | Suzuki | G10L 25/78 704/226 |
| 2015/0294666 | A1 | 10/2015 | Miyasaka et al. | 704/251 |

FOREIGN PATENT DOCUMENTS

| | | | | |
|---|---|---|---|---|
| DE | 102009051508 | A1 | 5/2011 | G10L 15/22 |
| EP | 1936939 | A1 | 6/2008 | H04M 9/08 |
| EP | 2466864 | A1 | 6/2012 | H04M 9/08 |
| JP | 2001100785 | A | 4/2001 | G10L 15/00 |
| WO | 2017/080830 | A1 | 5/1917 | H04R 3/02 |

OTHER PUBLICATIONS

Benesty, Jacob et al., "A Hybrid Mono/Stereo Acoustic Echo Canceler," IEEE Transactions on Speech and Audio Processing, vol. 6, No. 5, pp. 468-475, Feb. 14, 1997.
German Search Report, Application No. 102015222105.9, 7 pages, dated Jun. 24, 2016.
International Search Report and Written Opinion, Application No. PCT/EP2016/075831, 9 pages, dated Jan. 26, 2017.

* cited by examiner

AUDIO SIGNAL PROCESSING IN A VEHICLE

CROSS REFERENCE TO RELATED APPLICATIONS

This application claims priority to DE Application No. 10 2015 222 105.9 filed Nov. 10, 2015 with the German Patent and Trademark Office, the contents of which application are hereby incorporated by reference in their entireties.

TECHNICAL FIELD

The present invention relates to a method for audio signal processing in a vehicle and a corresponding audio signal processing device for a vehicle. The present invention relates in particular to audio signal processing with echo compensation, such as for speech processing.

BACKGROUND

In vehicles such as passenger vehicles or commercial vehicles, speech dialog systems are used to assist the driver or the passengers. Speech dialog systems serve, for example, to control electronic devices without the necessity of haptic operation. The electronic devices can, for example, comprise a vehicle computer or a multimedia system of the vehicle. Language spoken by the driver or passengers is received by a hands-free microphone and supplied to voice recognition.

Usage of microphones in the vehicle interior for, e.g., voice operation, telephoning, or vehicle interior communication can potentially be impaired by an acoustic coupling of speaker output from the vehicle sound system. This can lead to recognition errors in the case of speech recognition, echoes at the remote end in the case of hands-free telephoning, and feedback in the case of vehicle interior communication. Depending on the usage, the consequences can be impaired communication, increased distraction, or even disruptive noise and echoes.

If, for example, during spoken dialog in the vehicle audio signals are played back simultaneously and continuously by the vehicle's sound system, a part of the audio signals enters the hands-free microphone as acoustic feedback from the speakers and thereby disrupts speech recognition. The audio signals played back by the vehicle's sound system can, for example, comprise music, traffic messages, radio broadcasts, navigation system output, or the (artificial) speech of a speech dialog system. The interference with speech recognition can cause recognition errors that can render the dialog inefficient and cause increased distraction from the task of driving. This can trigger dissatisfaction or irritation in the driver or passengers.

A simple solution for the aforementioned problem consists of muting the audio playback of, for example, a radio during the speech dialog or telephone call in the vehicle. However, the muting of audio playback is frequently felt to be disruptive and unnecessary by vehicle users. Moreover, important information from, for example, a navigation system can be missed. Furthermore, a vehicle user can feel compelled to very rapidly react to the responses of the speech dialog system when the audio playback is simultaneously muted during responses from the speech dialog system.

Alternatively, the audio playback volume can be temporary reduced during the speech dialog. For the speech recognizer, the extent of the interference from the audio playback is indeed less but generally still large enough so that further cleanup of the microphone signal is required.

To a limited extent, the aforementioned couplings can also be reduced by design and acoustic measures. For example, microphones can be used with an appropriate directional characteristic, microphones and speakers in the vehicle interior can be appropriately arranged relative to each other, or acoustic conditions within the vehicle can be appropriately exploited.

However, since this is generally insufficient, signal processing components are employed to clean up the microphone signals. In this regard, the signal parts coupled by the speakers of the vehicle sound system into the microphones are estimated and removed from the microphone signals. Such methods are described as echo compensation or echo suppression. A widespread type of echo compensation is linear echo compensation.

With linear echo compensation, it is assumed that the microphones, speakers and their respective amplifiers are linear transmitters and that therefore the speaker noise parts in the microphone signal that are coupled into a specific microphone overlap linearly. It is furthermore assumed that these speaker noise parts result as a linear convolution of the respective speaker source signal with a respective impulse response. Each of these impulse responses refers to a specific microphone/speaker pair and characterizes the entire electroacoustic transmission path from the speaker source signal to the microphone signal. The following variables, inter alia, are therefore reflected in such an impulse response:

- the frequency and phase response of the amplifier upstream from the speaker,
- the frequency and phase response of the speaker,
- the spatial radiation pattern of the speaker,
- the acoustic transmission path from the speaker to the microphone through the vehicle interior, including reflections, diffraction, scatter, absorption, etc.,
- the spatial reception pattern of the microphone, and
- the frequency and phase response of the microphone.

This impulse response is therefore also described as an LEM impulse response (loudspeaker enclosure microphone). It generally changes over time due to changes in the vehicle interior geometry (passengers and their movements, moving parts, load, etc.) as well as in the electroacoustic properties of the microphone and speakers (depending on the temperature, air pressure, humidity, age, etc.).

An algorithm for linear echo compensation adaptively estimates the LEM impulse response for every possible microphone/speaker pair. On the basis of the LEM impulse response, the coupled speaker noise parts in each microphone signal are then calculated and subtracted therefrom. The adaptation speed and effective echo suppression are limited and generally compete with each other.

Various improved techniques for echo compensation or echo suppression are known in the prior art for, e.g., simplifying echo compensation and thereby reducing the required computation. In this regard, EP 1936939 A1 discloses echo compensation in which the microphone signal is divided into sub-band signals and subjected to undersampling. A reference audio signal is output by a speaker. The reference audio signal is also subjected to undersampling, and undersampled sub-band signals of the reference audio signal are saved. Moreover, echoes in the microphone sub-band signals are estimated, and the estimated echoes are removed from the microphone sub-band signals to obtain improved microphone sub-band signals.

With echo compensation, frequently existing multiple channels of the audio signal to be output are, however, problematic. The multichannel audio signal can, for example, be a stereo signal or a surround signal in the vehicle.

In the event of a plurality of audio source signals from a plurality of speakers, the following problem also occurs in addition to the increased calculation complexity: Given the correlations between the different audio source signals, the estimation problem is mathematically under-determined. As a consequence, when audio source signals suddenly occur, the effectiveness of echo compensation can be strongly reduced. It can even occur that the LEM estimation diverges, for example when changes in the surround sound pattern occur. This can occur, for example, when so-called phantom sound sources appear, disappear or move within the surround panorama.

Various approaches exist for circumventing this which, however, either lead to audible distortions or are very computation-intensive (watermarking, Kalman filter solutions).

In addition, an echo suppressor, for example, is known in this context from DE 102008027848 A1 that works together with a sound output device having a multichannel audio unit. The sound output device sends out output sound signals as analog signals from multiple channels through a plurality of speakers. A microphone detects an outside sound and generates an input sound signal as an analog signal. The outside sound comprises the output sound signals as an echo. The echo suppressor possesses an echo deletion function to remove the echo from the input sound signal. For this, the echo suppressor receives the output sound signals from the sound output device. Such a solution for compensating multichannel acoustic echo sources is, however, very technically complex and requires much computing power. Furthermore, there are no explicit solutions for numbers of channels that exceed two.

Another option is an improved separation of speech signals from general interfering signals. The general interfering signals can also comprise multichannel audio playbacks. This is, for example, considered in DE 102009051508 A1. To reduce interfering signals in speech recognition, a microphone array is installed instead of a single microphone. A multichannel speech signal is recorded by the microphone array and is supplied to an echo compensation unit instead of a single speech signal. Before being entered into the echo compensation unit, the multichannel speech signal recorded by the microphone array is processed further in a unit downstream from the microphone array for processing the microphone signals by a delayed summing of the signals. This separates the signals from the authorized speakers, and all other speaker signals and interfering signals are reduced. In addition, the echo compensation unit evaluates the propagation time of the different channels of the multichannel speech signal and removes all parts of the signal that, according to their propagation time, do not originate from the location of the authorized speaker. The use of a microphone array or a plurality of microphones, however, increases cost, necessitates more installation space and requires powerful computing resources.

SUMMARY

It is therefore an object to enable reliable speech input in a vehicle during the simultaneous playback of a multichannel audio signal. Additional costs or expenses for e.g. additional microphones or powerful signal processing units may thereby be avoided.

According to the present invention, this object is solved by a method for audio signal processing in a vehicle and an audio signal processing device for a vehicle according to the independent claims. Various embodiments are described in the dependent claims and the following description.

According to one aspect, a method is provided for audio signal processing in a vehicle. In the method, a mono audio signal is generated based on a multichannel audio source signal. The mono audio signal is limited to a frequency range between a given lower frequency and a given upper frequency. By limiting the mono audio signal to the frequency range, a limited mono audio signal is generated. The limited mono audio signal is output by the plurality of speakers in the vehicle. An influence of this limited mono audio signal output by the plurality of speakers on the speech audio signal received by the microphone is compensated by the limited mono audio signal.

BRIEF DESCRIPTION OF THE DRAWINGS

The invention is explained in the following using various exemplary embodiments.

DETAILED DESCRIPTION OF EMBODIMENTS

Figure 1:
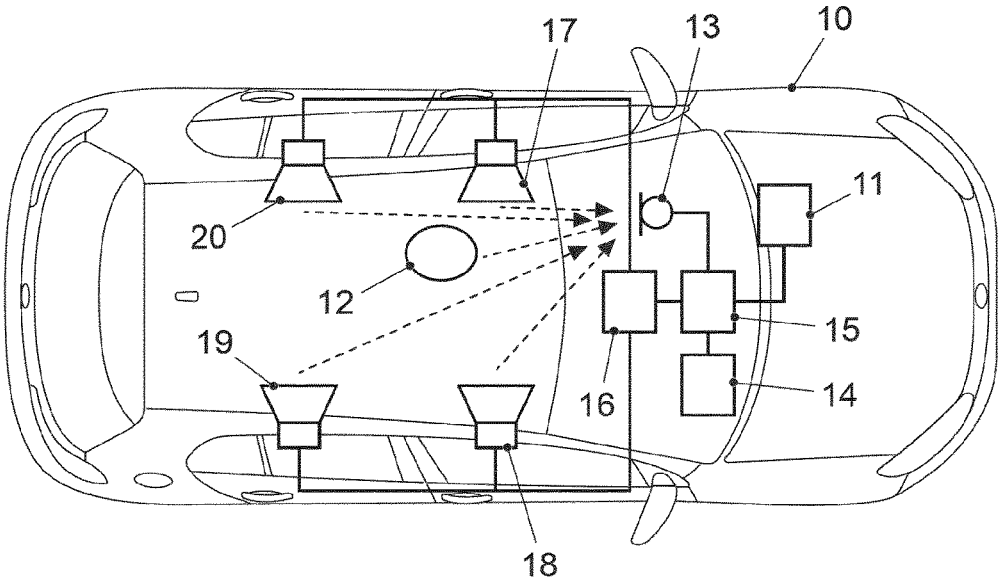
FIG. 1 schematically shows a vehicle with an audio signal processing device according to an embodiment of the present invention.

According to one aspect, a method is provided for audio signal processing in a vehicle. In the method, a mono audio signal is generated based on a multichannel audio source signal. The multichannel audio source signal is, for example, a stereo signal or a surround signal that is output in the vehicle by a plurality of speakers of the vehicle. The mono audio signal is limited to a frequency range between a given lower frequency and a given upper frequency. The mono audio signal can, for example, be limited with a bandpass filter to the frequency range between the given lower frequency and the given upper frequency. By limiting the mono audio signal to the frequency range, a limited mono audio signal is generated.

The limited mono audio signal is output by the plurality of speakers in the vehicle. If a speech audio signal from a vehicle passenger or a driver of the vehicle is received by a microphone, this speech audio signal contains the limited mono audio signal output by the plurality of speakers. An influence of this limited mono audio signal output by the plurality of speakers on the speech audio signal received by the microphone is compensated by the limited mono audio signal. For example and in some embodiments, echo compensation can be performed that only takes into account the mono audio signal. Complex echo compensation taking into account a multichannel audio signal is therefore unnecessary. Instead, only single-channel echo compensation may be used, which can be realized with comparatively little computing power.

Echo compensation taking into account only one echo signal (mono audio signal) is very reliable even if the mono audio signal is output by a plurality of different speakers since no changes in the multichannel sound pattern can occur with a mono audio signal. Accordingly, the interfering mono audio signal can be largely or completely removed from the speech audio signal.

The given lower frequency can, for example and in some embodiments, have a value within the range of 100 Hz to 300 Hz, and the given upper frequency can, for example, have a value within the range of 4 kHz to 8 kHz. A speech recognizer that, for example, is used for speech control or speech input in a vehicle in many cases only evaluates audio signals within a limited frequency range of, for example, 100 Hz to 8 kHz to recognize speech input from a user. Consequently, echo compensation is only necessary within this limited frequency range. In some embodiments, the given lower frequency is therefore 100 Hz and the given upper frequency is 8 kHz. The speech recognizer can thereby be provided an undisturbed speech signal within the limited frequency range relevant for the speech recognizer.

To still maintain an effect of multichannel audio playback, in one embodiment of the method, a plurality of limited channel-specific audio signals are also generated depending on the multichannel audio source signal. A channel-specific audio signal relates, for example, to an audio signal that is specially intended by the multichannel audio signal source for a speaker assigned to the respective channel. With a stereo source signal, this can, for example, comprise an audio signal for the right speaker, or an audio signal for the left speaker. A respective limited channel-specific audio signal from the plurality of limited channel-specific audio signals is therefore assigned to a respective audio signal from the multichannel audio source signal. A respective limited channel-specific audio signal is limited to a frequency range that only comprises frequencies below the given lower frequency and frequencies above the given upper frequency. A respective limited channel-specific audio signal is formed by a corresponding limiting of the frequency from the assigned audio signal of the multichannel audio source signal. Expressed otherwise, the audio signals from the multichannel audio signal are limited or filtered such that they only comprise frequencies below the given lower frequency and/or frequencies above the given upper frequency. The plurality of limited, channel-specific audio signals are output by the plurality of speakers in the vehicle so that the effect of multichannel audio playback can be achieved, such as stereo playback or surround playback. In summary, audio playback in the vehicle is modified in some embodiments so that the multichannel audio source signal is played back as a single channel (mono) in the frequency range between the given lower frequency and the given upper frequency, and is played back as multiple channels within the remaining frequency range.

The mono audio signal and the plurality of limited channel-specific audio signals may, for example, be generated from the multichannel audio source signal according to the following embodiment. With this embodiment, the multichannel audio source signal is divided into a mid-signal part that is the same on all channels and a respective side signal part per audio channel of the multichannel audio source signal. The limited mono audio signal is generated from the mid-signal part, and the plurality of limited channel-specific audio signals are generated from the respective side signal parts. The mid-signal part can, for example, be used directly as a mono audio signal or be used as a mono audio signal that is suitably scaled. Likewise, the side signal parts can be used directly as the limited channel-specific audio signals or in a suitably scaled form. In particular with a stereo signal, the mid-signal part can, for example, be formed from the sum of the right and left audio source signal. The side signal parts can be coded and further processed together in a differential signal consisting of the difference between the right and left audio source signal. In particular when processing a stereo source signal, the mid-signal part and the side signal parts can thus be easily generated and processed.

In another embodiment, the mid-signal part is formed by averaging respective sampling values of the audio channels of the multichannel audio source signal. The respective side signal parts are formed by subtracting the mid-signal part from the respective audio signals of the multichannel audio source signal. This generation of the mid-signal part and the side signal parts is feasible for audio source signals with any number of channels. Moreover, implementation can be easily realized in, for example, a digital signal processor.

In another embodiment of the method, the speech audio signal received by the microphone is limited to a frequency range between the given lower frequency and the given upper frequency. Echo compensation is applied to the speech audio signal limited in this manner using the limited mono audio signal in an embodiment. Accordingly, the influence of the limited mono audio signal output by the plurality of speakers on the limited speech audio signal is compensated. Since the speech recognizer generally only operates within the frequency range between the given lower frequency and the given upper frequency, echo compensation in a speech audio signal limited thereto is sufficient. Moreover, interfering signals outside of this frequency range are already eliminated before echo compensation and therefore do not have any influence on echo compensation and speech recognition, which allows both echo compensation as well as speech recognition to work more reliably.

In some cases, the playback of an audio signal is more important for some passengers of the vehicle than for others. For example, audio output from a navigation system is more important for the driver than for the other passengers, whereas audio output from a video played back in the rear of the vehicle is more important for vehicle passengers in the rear than for the driver and front passenger. According to one embodiment, a plurality of weighting factors assigned to the respective speakers can be generated depending on the multichannel audio source signal. The limited mono audio signal is weighted for each speaker using the weighting factor assigned to the respective speaker. This allows a focus of the audio output within the vehicle to be appropriately shifted.

As long as the weighting factors are basically static, the weighted output does not have any influence on the quality of the echo compensation. If the weighting is modified, the echo compensation can adjust within a relatively short time, such as within a few seconds or minutes, to the new weighting. In the aforementioned example of the audio output from the navigation system, the following weighting can be used in a vehicle with, for example, four speakers instead of output from the mono audio signal being evenly distributed over the four speakers. The speaker in the region of the driver can, for example, output 70% of the mono audio signal, and the other three speakers can, for example, only output 10% of the mono audio signal.

According to a further aspect, an audio signal processing device for a vehicle is also provided. The audio signal processing device is capable of generating a mono audio signal based on a multichannel audio source signal. For this, the audio signal processing device can, for example, have a summing device. The audio signal processing device is moreover capable of limiting the mono audio signal to a frequency range between a given lower frequency and a given upper frequency. This can, for example, be realized with a bandpass filter. The limited mono audio signal is output by a plurality of speakers in the vehicle. Furthermore, the limited mono audio signal is output to a compensation device such as an echo compensation device. By means of the limited mono audio signal, the compensation device serves to compensate an influence of the limited mono audio signal output by the plurality of speakers on a speech audio signal received by a microphone in the vehicle. The audio signal processing device is therefore suitable for performing the above-described method and its embodiments and therefore also comprises the above-described advantages.

Further embodiments of the present invention will be described in detail below with reference to the accompanying figures.

Figure 2:
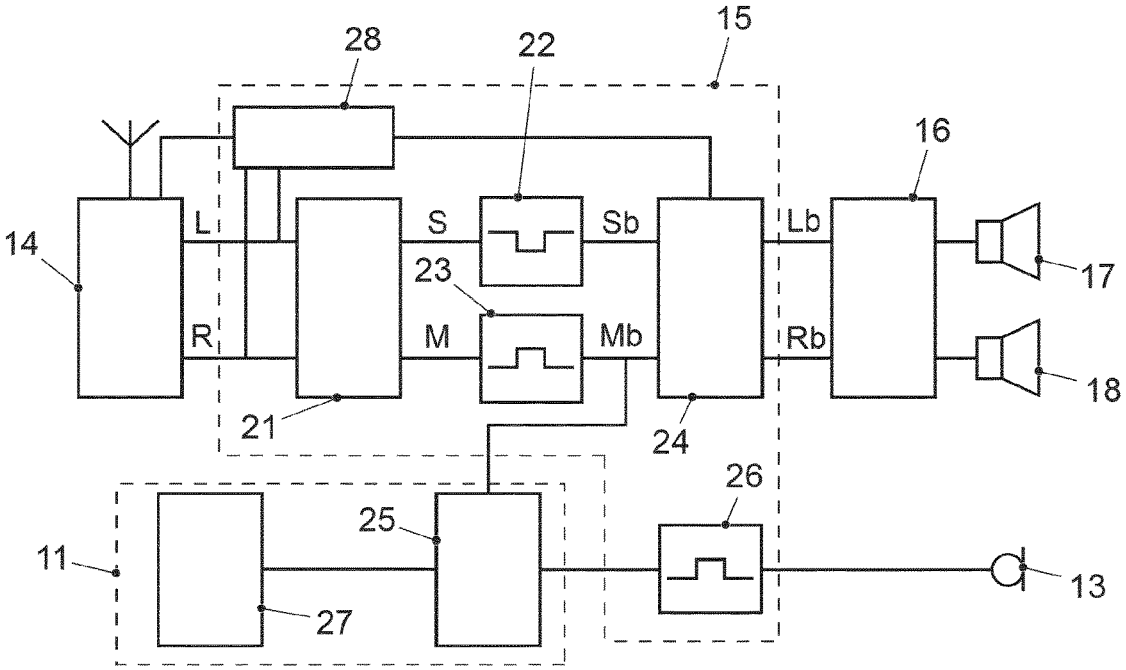
FIG. 2 schematically shows an audio playback system and a speech recognition system in conjunction with an audio signal processing device according to an embodiment of the present invention.
Figure 3:
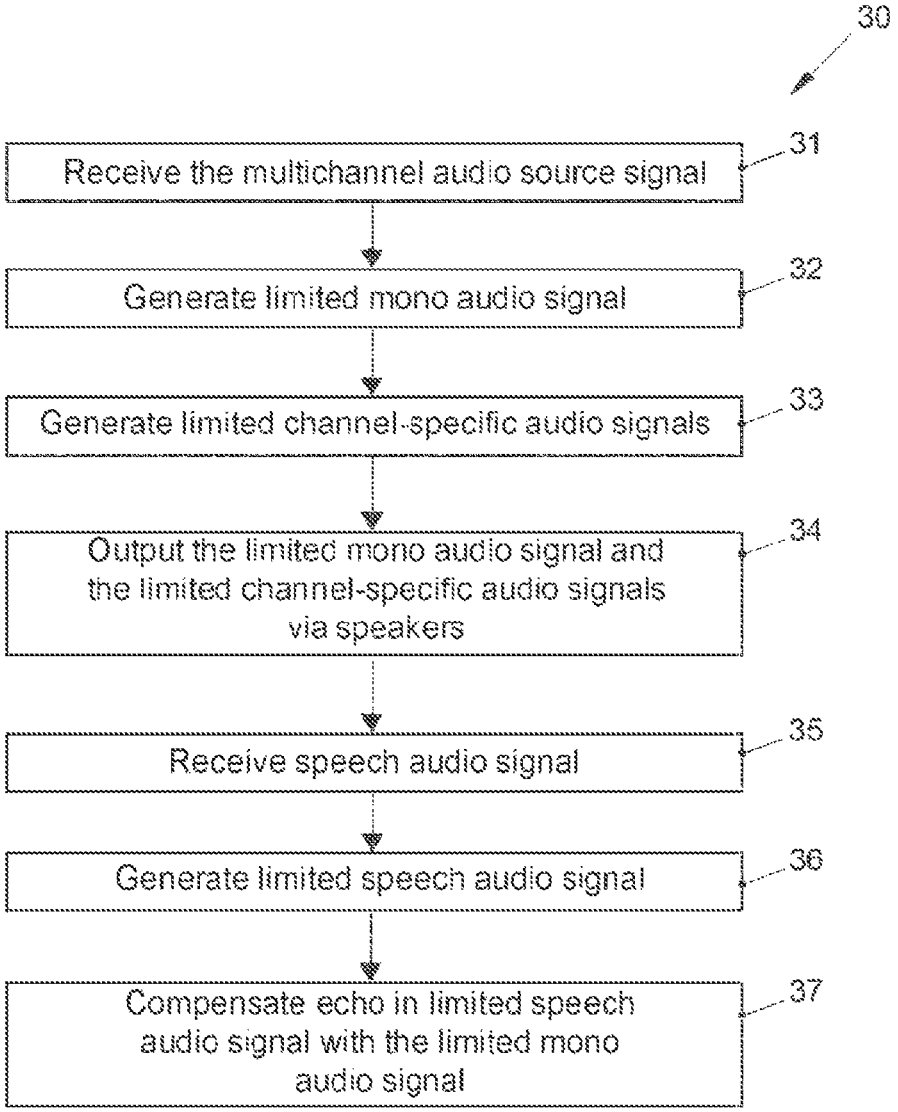
FIG. 3 schematically shows a method for audio signal processing in a vehicle according to an embodiment of the present invention.

FIG. 1 first describes the surroundings of an audio signal processing device 15 in a vehicle 10. FIG. 2 describes details of the audio signal processing device 15 in conjunction with other components of the vehicle 10. FIG. 3 finally schematically shows the operation of the audio signal processing device 15. The same reference numbers in the FIGS. relate to the same or similar components.

FIG. 1 shows a vehicle 10 in a plan view. The vehicle 10 comprises a speech recognition system 11. Spoken commands or instructions from passengers of the vehicle 10 can be detected, processed and executed by the speech recognition system 11. For example, configuration settings of the vehicle 10 or of a multimedia system in the vehicle 10 can be changed with corresponding instructions. For example, an audio signal source such as a CD or radio can be selected. Furthermore, for example, a specific radio station can be selected, or a title of a CD. Furthermore, a telephone connection can be established to a desired participant using corresponding instructions, or a navigation goal can be set in a navigation system of the vehicle 10. For this, for example, corresponding commands or instructions from a driver 12 of the vehicle 10 are received by a microphone 13. A spoken command from the driver 12 is forwarded by the microphone 13 as a speech audio signal to an audio signal processing device 15. The operation of the audio signal processing device 15 will be described in detail below with reference to FIG. 2. After the speech audio signal is processed in the audio signal processing device 15, the processed speech audio signal is supplied to the speech recognition system 11. The speech recognition system 11 evaluates the speech audio signal and recognizes commands and instructions contained therein and executes them. The speech recognition system can be coupled to a so-called dialog system that can carry out a dialog with the driver through questions and responses.

The vehicle 10 furthermore comprises an audio signal source 14. The audio signal source 14 can, for example, comprise a radio receiver, a media playback device such as a CD player or an MP3 player, or a navigation system of the vehicle 10. The audio signal source 14 outputs a multichannel audio source signal. The multichannel audio source signal is supplied to the audio signal processing device 15 and processed there as described below with reference to FIG. 2. The processed multichannel audio source signal is output by the audio signal processing device 15 to an amplifier 16. The amplifier 16 amplifies the individual signals of the processed multichannel audio source signal so that they can be played back by speakers 17-20 in an interior of the vehicle 10.

In the example shown in FIG. 1, the vehicle 10 comprises four speakers 17-20. In other embodiments, the vehicle 10 can comprise any number of speakers such as two, three, or more than four. In the example shown in FIG. 1, the speakers 17-20 are assigned to the seats in the vehicle 10. Accordingly, the speaker 17 is assigned to a driver seat of the driver 12, the speaker 18 is assigned to a front passenger seat, the speaker 19 is assigned to a rear right seat, and the speaker 20 is assigned to a rear left seat.

While operating the vehicle 10, the driver 12 can give instructions or commands to the speech recognition system 11. This is shown in FIG. 1 by the dashed arrow between the driver 12 and the microphone 13. While the driver 12 gives commands and instructions, multichannel audio source signals can be output by the audio signal source 14 via the speakers 17-20. The output from the speakers 17-20 also reaches the microphone 13 as shown in FIG. 1 by the corresponding dashed arrows between the speakers 17-20 and the microphone 13. The output from the speakers 17-20 can however interfere with the understandability of speech such that the speech recognition system 11 does not recognize or only insufficiently recognizes the commands and instructions from the driver 12.

FIG. 2 shows details of the audio signal processing device 15 and the speech recognition system 11 that help reduce or compensate the influence of the output from the speakers 17-20 on the speech signal of the driver 12. To simplify the depiction, the audio signal source 14 in the example in FIG. 2 is only two-channel, i.e., a stereo source with a left channel L and a right channel R. It is however clear that the audio signal processing device 15 described below can process any number of channels from a multichannel audio signal source in the same manner.

Before the operation of the audio signal processing device 15 is described, first the components of the audio signal processing device 15 shown in FIG. 2 will be described. The components of the audio signal processing device 15 shown in FIG. 2 do not necessarily have to actually be designed as specific components or assemblies; rather, they can be partially or entirely reproduced by programming or realized by a suitable control, for example a microprocessor or a digital signal processor.

The audio signal processing device 15 comprises inputs through which the multichannel audio source signal is received from the audio signal source 14. A two-channel stereo audio source signal comprises for example a left channel L and a right channel R that are supplied to the audio signal processing device 15. By means of a first signal converter 21, a mid-signal part M is generated from the two-channel or multichannel audio source signal, and a side signal part S is generated for each channel. Instead of two side signal parts, a common side signal part can be formed as a difference from the left channel L and the right channel R, especially for a stereo signal. Since all of the side signal parts are then treated equally independent of the number of side signal parts, only one path for the side signal parts S is shown in FIG. 2. In the case of a stereo signal, this one path can according comprise just one side signal part, or a plurality of side signal parts in the case of multiple channels.

The mid-signal part M can, for example, comprise a sum signal consisting of all supplied channels. In the case of a stereo signal, the mid-signal part M can therefore comprise the sum signal consisting of the left channel L and right channel R (M=R+L). A respective side signal part S can, for example, comprise a differential signal between the respective audio signal of the respective channel of the multichannel audio source signal and the mid-signal part. Especially in the case of a stereo signal, the side signal part S can also, for example, comprise a differential signal consisting of the right channel R and the left channel L (S=R−L).

The audio signal processing device 15 furthermore comprises a first bandpass filter 23 and a notch filter 22. The first bandpass filter 23 has a given lower frequency and a given upper frequency. The first bandpass filter 23 basically only lets signals pass with a frequency between the given lower frequency and the given upper frequency. Signals with a frequency below the given lower frequency as well as signals with a frequency above the given upper frequency are basically suppressed or at least strongly dampened. In an analog design of the first bandpass filter 23, the damping can, for example, be 70 dB or more, and in a digital design of the first bandpass filter, the signal above the given upper frequency and below the given lower frequency can be entirely suppressed. The notch filter 22 has a frequency response that is basically inverse to the frequency response of the first bandpass filter 23. I.e., the notch filter 22 basically only lets signals pass with a frequency below the given lower frequency or above the given upper frequency. The lower given frequency can, for example, be 100 Hz, and the upper given frequency can, for example, be 8 kHz. Alternatively, the lower given frequency can be selected within a range of 100 Hz to 300 Hz, and the upper given frequency can be selected within a range of 4 kHz to 8 kHz. The larger the selected frequency range between the lower given frequency and the upper given frequency, the more reliably the speech recognition works. However, playback of a multichannel audio source signal is increasingly impaired the larger the selected frequency range between the lower given frequency and the upper given frequency. In the event that a plurality of side signal parts are generated, a corresponding notch filter 22 with the lower given frequency and the upper given frequency is provided for each of these plurality of side signal parts.

By filtering the mid-signal part M with the bandpass filter 23, a filtered or frequency-limited mid-signal part Mb is generated. By filtering the side signal parts S with the notch filters 22, filtered or frequency-limited side signal parts Sb are generated. The filtered mid-signal part Mb and the filtered side signal parts Sb are supplied to a second signal converter 24 that generates filtered audio signals for the individual channels. The filtered audio signal for a respective individual channel can, for example, be formed by summing the filtered mid-signal part Mb and the corresponding filtered channel-specific side signal part Sb. Especially in the case of a stereo audio source signal, Rb=Mb+Sb and Lb=Mb−Sb for example applies. The filtered audio signals Lb, Rb are output by the audio signal processing device 15 and supplied channel-wise to the amplifier 16.

The audio signal processing device 15 furthermore comprises a second bandpass filter 26. The second bandpass filter 26 has the same filter characteristics as the first bandpass filter 23. At the input side, the second bandpass filter 26 is coupled to the microphone 13 and, at the output side, is coupled to an echo compensator 25 of the speech recognition system 11. Furthermore, the filtered mid-signal part Mb is supplied to the echo compensator 25 of the speech recognition system 11. Based on the filtered mid-signal part Mb, the echo compensator 25 performs an echo compensation for the filtered speech signal from the microphone 13. The speech signal processed by the echo compensator 25 is supplied to a speech recognizer 27 of the speech recognition system 11.

In addition, the audio signal processing device 15 comprises a weighting device 28 that is coupled to the multichannel audio source signal and/or the audio signal source 14. Based on information in the multichannel audio source signal or information from the audio signal source 14, the weighting device 28 provides weighting factors by means of which the filtered audio signals are weighted before they are output by the second signal converter 24.

With reference to FIG. 3, the operation of the audio signal processing device 15 in the vehicle 10 will be described below. FIG. 3 shows a method 30 with method steps 31-37 that are executed by the audio signal processing device 15 in conjunction with the speech recognition system 11. It is clear that the processing steps shown in FIG. 3 can be executed with electronic resources that, for example, comprise analog or digital circuits as well as processing devices. Processing devices can, for example, comprise microprocessors or digital signal processors. Furthermore, the overall functionality of the audio signal processing device 15 can be integrated into, for example, an existing electronic device, such as into a digital signal processor of the speech recognition system 11.

In step 31, a multichannel audio source signal such as a stereo signal or a surround signal is received by the audio signal source 14 on the audio signal processing device 15. In steps 32 and 33, a limited-frequency mono audio signal and frequency-limited channel-specific audio signals are generated with the assistance of the first signal converter 21 and the filters 22 and 23. The frequency-limited mid-signal part Mb described above can, for example, be the frequency-limited mono audio signal. The frequency-limited side signal parts Sb described above can, for example, be the frequency-limited channel-specific audio signals. The frequency-limited mono audio signal and the frequency-limited channel-specific audio signals can, however, also be formed in any other manner from the multichannel audio source signal, for example in a digital signal processor.

In step 34, the limited mono audio signal is output by all the speakers 17-20, and the limited channel-specific audio signals are output by the speaker assigned to the respective channel. The mono audio signal is limited to a frequency range relevant to speech recognition such as a frequency range of 100 Hz to 8 kHz. The channel-specific audio signals are limited to a frequency range outside of the frequency range relevant to voice recognition, i.e., for example to frequencies below 100 Hz and above 8 kHz. By reducing the multiple channels of the audio playback within the frequency range relevant to the voice recognizer 27, only the one-channel mono audio signal is available as an interfering signal for the voice recognition. For the passenger(s), however, a sense of three-dimensionality in the sound perception is retained since the multiple channels are retained for frequencies outside of the range relevant to speech recognition.

When the limited mono audio signal is output by the speakers 17-20, an audio focus within the vehicle can be changed. For example, the weighting device 28 can determine an audio focus for the multichannel audio source signals or the current signal source based on the information supplied to it, and can distribute the limited mono audio signal to the audio channels according to this audio focus. If, for example, speech output from a navigation system represents the multichannel audio signal source, the limited mono audio signal can, for example, be weighted more strongly for speaker 17 than for the speakers 18-20 since this information is more relevant to the driver 12 than to the other vehicle passengers. The weighting device 28 can consider other information about the vehicle 10 such as a current seat occupancy within the vehicle.

For speech recognition, a speech audio signal is received by the microphone 13 in step 35. In step 36, the frequency of the received speech audio signal is limited with the assistance of the second bandpass filter 26. The limited mono audio signal and the limited speech audio signal are supplied to the echo compensator 25. In step 37, the echo compensator 25 carries out echo compensation in the speech audio signal using the mono audio signal. Since both the speech audio signal as well as the mono audio signal are limited to the frequency range relevant to speech recognition (such as 100 Hz-8 kHz), the echo compensation can also be restricted to this limited frequency range, whereby less interference arises and the echo compensator 25 can be designed more simply, or less computation is required. Furthermore, single-channel echo compensation only requires a single audio reference signal, i.e., the mono audio signal, and only has to estimate one acoustic impulse response. This saves system resources in echo compensation that, for example, are available for the speech recognizer 27.

The speech audio signal cleaned up in this manner is supplied to the speech recognizer 27 and processed there in order to extract corresponding commands and instructions from the spoken speech.

In the claims, the word "comprising" does not exclude other elements or steps, and the indefinite article "a" or "an" does not exclude a plurality. A single processor, module or other unit may fulfil the functions of several items recited in the claims.

The mere fact that certain measures are recited in mutually different dependent claims or embodiments does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

REFERENCE NUMBER LIST

10 Vehicle
11 Speech recognition system
12 Vehicle passenger
13 Microphone
14 Audio signal source
15 Audio signal processing device
16 Amplifier
17-20 Speaker
21 First signal converter
22 Notch filter
23 First bandpass filter
24 Second signal converter
25 Echo compensator/compensation device
26 Second bandpass filter
27 Speech recognizer
28 Weighting device
30 Method
31-37 Step

What is claimed is:

1. A method for audio signal processing in a vehicle comprising:

generating a mono audio signal based on a multichannel audio source signal;

limiting the mono audio signal to a frequency range between a given lower frequency and a given upper frequency;

outputting the limited mono audio signal via a plurality of speakers in the vehicle; and compensating an influence of the limited mono audio signal output by the plurality of speakers on a speech audio signal received by a microphone in the vehicle by means of the limited mono audio signal; wherein the given lower frequency has a value within a range of 100 Hz to 300 Hz and the given upper frequency has a value within a range of 4 kHz to 8 kHz.

2. The method of claim 1, further comprising:

generating a plurality of limited channel-specific audio signals depending on the multichannel audio source signal such that a respective limited channel-specific audio signal from the plurality of limited audio signals is assigned to a respective audio signal from the multichannel audio source signal and is limited to a frequency range below the given lower frequency and/or above the given upper frequency; and outputting the plurality of limited channel-specific audio signals via the plurality of speakers in the vehicle.

3. The method of claim 2, wherein the multichannel audio source signal is divided into a mid-signal part that is the same on all channels and a respective side signal part per audio channel of the multichannel audio source signal; the mid-signal part is used to generate the limited mono audio signal; and the respective side signal parts are used to generate the plurality of limited channel-specific audio signals.

4. The method of claim 3, wherein the mid-signal is formed by averaging respective sampling values of the audio channels of the multichannel audio source signal; and the respective side signal parts are formed by subtracting the mid-signal from the respective audio signals of the multichannel audio source signal.

5. The method of claim 1, wherein the speech audio signal received by the microphone is limited to a frequency range between the given lower frequency and the given upper frequency; and the influence of the limited mono audio signal output by the plurality of speakers on the limited speech audio signal is compensated.

6. The method of to claim 1, further comprising:

generating a plurality of weighting factors assigned to at least some of the speakers depending on the multichannel audio source signal; and outputting a limited mono audio signal weighted with the weighting factor assigned to the respective speaker via the respective speaker.

7. The method of claim 1, further comprising:

generating a plurality of limited channel-specific audio signals depending on the multichannel audio source signal such that a respective limited channel-specific audio signal from the plurality of limited audio signals is assigned to a respective audio signal from the multichannel audio source signal and is limited to a frequency range below the given lower frequency and/or above the given upper frequency; and outputting the plurality of limited channel-specific audio signals via the plurality of speakers in the vehicle.

8. An audio signal processing device for a vehicle that is configured to generate a mono audio signal based on a multichannel audio source signal;

to limit the mono audio signal to a frequency range between a given lower frequency and a given upper frequency;

to output the limited mono audio signal via a plurality of speakers in the vehicle; and to output the limited mono audio signal to a compensation device in order to compensate an influence of the limited mono audio signal output by the plurality of speakers on a speech audio signal received by a microphone in the vehicle by means of the limited mono audio signal; wherein the given lower frequency has a value within a range of 100 Hz to 300 Hz and the given upper frequency has a value within a range of 4 kHz to 8 kHz.

9. The audio signal processing device according to claim 8, wherein the audio signal processing device is designed to perform the method according to claim 1.

10. The audio signal processing device according to claim 8, wherein the audio signal processing device is designed to perform the method according to claim 2.

11. The audio signal processing device according to claim 8, wherein the audio signal processing device is designed to perform the method according to claim 3.

12. The audio signal processing device according to claim 8, wherein the audio signal processing device is designed to perform the method according to claim 4.

13. The audio signal processing device according to claim 8, wherein the audio signal processing device is designed to perform the method according to claim 5.

14. The audio signal processing device according to claim 8, wherein the audio signal processing device is designed to perform the method according to claim 6.

* * * * *